US007052118B2

(12) United States Patent
Akahane

(10) Patent No.: US 7,052,118 B2
(45) Date of Patent: May 30, 2006

(54) LIQUID EJECTION HEAD

(75) Inventor: Fujio Akahane, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 124 days.

(21) Appl. No.: 10/750,212

(22) Filed: Jan. 2, 2004

(65) Prior Publication Data

US 2004/0179061 A1 Sep. 16, 2004

(30) Foreign Application Priority Data

Jan. 6, 2003 (JP) ..... P2003-000635

(51) Int. Cl.
*B41J 2/45* (2006.01)

(52) U.S. Cl. ..... 347/68; 347/70

(58) Field of Classification Search ..... 347/68–70, 347/40, 43, 71, 72
See application file for complete search history.

(56) References Cited

U.S. PATENT DOCUMENTS 6,325,489 B1 * 12/2001 Endo ..... 347/43
6,371,601 B1 * 4/2002 Katakura ..... 347/68

FOREIGN PATENT DOCUMENTS

JP 10-217452 A 8/1998
JP 2001-047622 A 2/2001
JP 2002-137402 A 5/2002

* cited by examiner

*Primary Examiner*—Lamson Nguyen
(74) *Attorney, Agent, or Firm*—Sughrue Mion, PLLC

(57) ABSTRACT

Each of liquid ejection units has a casing body having a first pair of faces extending in a first direction, and a second pair of faces connecting the first pair of faces and extending obliquely relative to the first direction, and a plurality of nozzles arranged in the first direction to form a first nozzle array and a second nozzle array. The liquid ejection units are arranged such that one of the second pair of faces in one of the liquid ejection units and one of the second pair of faces in another one of the liquid ejection units are confronted with each other, so that the liquid ejection units are overlapped in both of the first direction and a second direction which is perpendicular to the first direction. Accordingly, the first nozzle array in one of the liquid ejection units and the first nozzle array in another one of the liquid ejection units constitute a first nozzle group, which is continuous as viewed from the second direction, for ejecting a first kind of liquid.

13 Claims, 15 Drawing Sheets

LIQUID EJECTION HEAD

BACKGROUND OF THE INVENTION

The present invention relates to a liquid ejection head in which the substantial length of a nozzle array for injecting a liquid is set to be as long as possible.

There has been known a liquid ejection head for injecting various kinds of liquid from a nozzle orifice. In particular, typical examples include a recording head to be mounted in an ink jet recording apparatus. Therefore, the related art will be described by taking the ink jet recording apparatus as an example.

As shown in FIG. 10, the ink jet recording apparatus 50 comprises a carriage 3 on which an ink cartridge 1 is mounted and to which a recording head 2 is attached.

The carriage 3 is connected to a stepping motor 5 through a timing belt 4, and is guided by a guide rod 6 and is reciprocated in the direction of the width of a recording medium 7 such as recording paper (primary scanning direction). The carriage 3 takes the shape of a box which is opened upward and is attached in such a manner that the nozzle formation surface of the recording head 2 is exposed to face the recording medium 7 (a lower surface in this example).

An ink is supplied from the ink cartridge 1 to the recording head 2 and an ink drop is discharged onto the upper surface of the recording medium 7 while moving the carriage 3, so that an image and a character are printed on the recording medium 7 in a dot matrix.

In order to guide the movement of the recording medium 7, there is provided a guide member 8 elongated in the primary scanning direction of the recording head 2. A wiper device 9 for cleaning a nozzle plate 17' (which will be described below) of the recording head 2 and a capping device 10 for normalizing the viscous state of the ink in the nozzle orifice are provided adjacently to one end side of the guide member 8. A flushing box 11 having an opening 12 is provided adjacently to the other end side of the guide member 8.

A waste ink absorbed by the cleaning operation carried out by the capping device 10 and a waste ink discharged from the recording head 2 by the flushing operation with respect to the opening 12 are stored in a waste ink storage 13.

Although the ink jet recording apparatus 50 has been described as a part of the related art, it has such a structure that the liquid ejection head according to the invention can be mounted therein.

An ink ejection unit U' included in the recording head 2 will be described with reference to FIGS. 11 to 13.

The ink ejection unit U' is constituted by a head case 14' and a channel unit 16' fixed to a surface 15' of the head case 14' with an adhesive. The channel unit 16' is constituted by laminating and bonding a nozzle plate 17, a channel forming substrate 18' and a sealing plate 19' also serving as a vibrating plate.

The nozzle plate 17' is formed by a stainless plate, and is provided with a large number of nozzle orifices 20 to form two nozzle arrays 21. The channel forming substrate 18' is formed by a monocrystalline silicon substrate and formed with pressure generating chambers 22 to be communicated with the nozzle orifices 20 and a damper concave portion 27 communicating with the atmosphere (not shown) which are formed by anisotropic etching. In the head case 14, an ink reservoir 23 communicating with an ink supply tube 26 is formed so as to communicate with the pressure generating chambers 22 through ink supply ports 25 formed in the sealing plate 19.

The sealing plate 19' is formed by laminating a resin film and a stainless plate, and an island portion 19A of the stainless plate is formed on the back face of a portion corresponding to each of the pressure generating chambers 22. Moreover, there is formed a compliance portion 19C which is formed by only a resin film having almost the same contour as that of the ink reservoir 23 to be described below.

The head case 14' is an injection molded product formed by a thermosetting resin or a thermoplastic resin, and is provided with the ink supply tube 26 for introducing ink to the ink reservoir 23. The damper concave portion 27 having an almost coincident shape with the shape of the ink reservoir 23 is formed in a portion of the channel forming substrate 18' which corresponds to the ink reservoir 23.

Piezoelectric vibrators 30 are fixed on a fixing board 29 to form a piezoelectric violator unit 35 to be housed in a chamber 31. Each of the piezoelectric vibrators 30 is a vibrator element of longitudinal vibration mode which expands or contracts in its longitudinal direction in accordance with input of a drive signal to apply pressure fluctuation in the associated one of the pressure generating chamber 22.

The damper concave portion 27 is a space formed by the sealing plate 19' for sealing an opening on the lower side of the ink reservoir 23 and a concave portion formed in the channel forming substrate 18, and serves to absorb pressure fluctuation in the ink reservoir 23 at time of the discharge of an ink drop by the deformation of the compliance portion 19C. During the deformation of the compliance portion 19C, air in the damper concave portion 27 is released from an air releasing hole (not shown) to the outside, thereby preventing pressure rising in the damper concave portion 27.

The ink ejection unit U' having the structure described above is assembled in the following manner, for example. An adhesive is first applied onto the surface 15' of the head case 14' in order to prevent ink from flowing into the ink supply tube 26 and the chamber 31 or an adhesive sheet formed by punching to have a predetermined shape is stuck to the surface 15. The channel unit 16' preassembled by bonding with an adhesive or the like is then mounted thereon. Subsequently, heating is carried out to have a temperature of approximately 40 to 100° C. and pressing is performed if necessary, thereby fixing the channel unit 16' to the head case 14.

On the other hand, the piezoelectric vibrator unit 35 formed by fixing the piezoelectric vibrators 30 to the fixing board 29 is prepared and an adhesive is applied onto the tip ends of the piezoelectric vibrators 30. Next, the head case 14' is inverted such that the channel unit 16' faces downward. The piezoelectric vibrator unit 35 is accommodated in the chamber 31 and is bonded and fixed thereto. In this state, the tip ends of the piezoelectric vibrators 30 are bonded and fixed to the sealing plate 19' of the channel unit 16' and the fixing board 29 is finally fixed to the head case 14' so that the ink ejection unit U' is finished.

In the ink ejection unit U', a driving signal generated in a driving circuit (not shown) is input to each of the piezoelectric vibrators 30 through a flexible cable 32, thereby expanding or contracting the piezoelectric vibrator 30. By the expansion and contraction of the piezoelectric vibrator 30, the island portion 19A of the sealing plate 19' is vibrated to change pressure in the pressure generating chamber 22, thereby discharging ink in the pressure generating chamber 22 as an ink drop from the nozzle orifice 20.

The ink ejection unit U' is attached to a plate-shaped head holder 33 through a coupling member 34. A pipe-shaped connector 36 is attached to the head holder 33 to lead ink from the ink cartridge 1 to the ink ejection unit U'. The connector 36 may be an ink supply needle (not shown) to pierce the inside of the ink cartridge 1 when the ink cartridge 1 is attached to the head holder 33.

A filter 37 is provided on the downstream side of the connector 36 and serves to catch impurities in the ink and to prevent the impurities from flowing into the ink supply tube 26.

Since the two nozzle arrays 21 are provided as described above, the pressure generating chambers 22, the ink reservoir 23 and the piezoelectric vibrator unit 35 are correspondingly arranged in two sets.

It is effective that the length of the nozzle array is elongated in a direction perpendicular to the primary scanning direction (hereinafter, referred as a secondary scanning direction) in order to enhance a printing speed, that is, increasing a printing area per unit time. In order to merely elongate the length of the nozzle array 21 in one ink ejection unit U', however, it is necessary to maintain the relative positions among the nozzle orifices 20, the pressure generating chambers 22 and the piezoelectric vibrators 30 with high precision. Therefore, this method cannot be a proper measure.

As shown in FIG. 13C, the ink ejection units U may be arranged in the secondary scanning direction. However, the nozzle array 21 is not continuous so that a discontinuous interval L is formed.

The adherence relationship between the fixing board 29 and the chamber 31 is necessary for attaching the piezoelectric vibrator unit 35 into an accurate position. For this purpose, the end of the fixing board 29 is adhered to three internal walls 31X, 31Y and 31Z for positioning of the chamber 31 and a stopper wall 31D provided in an inserting direction so that the relative positions of the piezoelectric vibrators 30 and the pressure generating chambers 22 are maintained accurately. Since the fixing board 29 requires a predetermined width to fulfill such a positioning function, the total width of piezoelectric vibrators 30 in the direction of the nozzle array 21 is to be smaller than the width of the fixing board 29. At the same time, the thickness of the head case 14' is also considered so that an interval L/2 is formed between the end of the ink ejection unit U' and the end of the nozzle array 21 as shown in FIG. 13B.

In other words, the width of the fixing board 29 in the direction of the nozzle array 21 is set to be greater than length of the nozzle array 21. A difference between the lengths forms the interval L/2.

As shown in FIG. 14, the ink ejection unit U' may be arranged in a zigzag manner to continuously provide each nozzle array 21 without the interval L viewed from the primary scanning direction, thereby substantially increasing the length of the nozzle array 21. In other words, the nozzle array 21 of each ink ejection unit U' is continuously provided in a zigzag manner relative to the primary scanning direction, so that a long nozzle array having no break is formed relative to the secondary scanning direction. The ink ejection units U provided adjacently to each other have an overlapping array over a length corresponding to the interval L.

Even if a long nozzle array can be formed by the above configuration, since the width of the ink ejection unit U' in the primary scanning direction is simply added, the dimension of the apparatus body in the primary scanning direction is remarkably increased so that the ink ejection head becomes large-sized. Moreover, since the stroke length of the carriage 3 in the primary scanning direction is determined such that the recording head 2 is wholly placed outside the recording region in which the recording medium 7 is placed, the added width of the recording head 2 causes disadvantages in view of the downsizing of the apparatus

SUMMARY OF THE INVENTION

It is therefore an object of the invention to provide a liquid ejection head capable of reducing the dimension of an apparatus body in the primary scanning direction as much as possible, while elongating the substantial length of a nozzle array.

In order to achieve the above object, according to the invention, there is provided a liquid ejection head, comprising:

a plurality of liquid ejection units, each comprising:

a casing body, having a first pair of faces extending in a first direction, and a second pair of faces connecting the first pair of faces and extending obliquely relative to the first direction; and a plurality of nozzles, from which liquid droplets are ejected, the nozzles arranged in the first direction to form a first nozzle array and a second nozzle array, wherein:

the liquid ejection units are arranged such that one of the second pair of faces in one of the liquid ejection units and one of the second pair of faces in another one of the liquid ejection units are confronted with each other, so that the liquid ejection units are overlapped in both of the first direction and a second direction which is perpendicular to the first direction;

the first nozzle array in one of the liquid ejection units and the first nozzle array in another one of the liquid ejection units constitute a first nozzle group, which is continuous as viewed from the second direction, for ejecting a first kind of liquid; and the second nozzle array in one of the liquid ejection units and the second nozzle array in another one of the liquid ejection units constitute a second nozzle group, which is continuous as viewed from the second direction, for ejecting a second kind of liquid.

Here, the first kind of liquid and the second kind of liquid may be identical with each other, or may be different from each other.

According to the above configuration, the dimension of the liquid ejection head in the second direction can be reduced, while securing nozzle groups elongated in the first direction. Therefore, ejecting operation such as printing can be efficiently performed with a downsized head.

The casing body is formed with a chamber for accommodating a plurality of vibrator units which extends in a third direction which is orthogonal to the first direction and the second direction. Each of the vibrator units comprises: a fixation board, fixed on an inner face of the chamber; and a plurality of piezoelectric vibrators, arranged on the fixation board in the first direction to cause pressure fluctuation in liquid contained in pressure generation chambers which are respectively communicated with the nozzles in one of the first nozzle array and the second nozzle array.

Here, it is preferable that the second pair of faces extend in the third direction, and are parallel to each other as viewed from the third direction.

In such a configuration, the liquid ejection units are arranged in order based on parallelograms, so that the first nozzle group and the second nozzle group are accurately established.

A dimension of the fixation board in the first direction is greater than a length of each of the first nozzle array and the second nozzle array. Even in such a configuration, the first nozzle group and the second nozzle group are accurately established.

Preferably, lengths of the first nozzle array and the second nozzle are identical with each other.

Each of the liquid ejection units comprises a first liquid reservoir communicated with the nozzles in the first nozzle array, and a second liquid reservoir communicated with the nozzles in the second nozzle array. Here, it is preferable that the first nozzle array and the second nozzle array are arranged between the first liquid reservoir and the second liquid reservoir, as viewed from a third direction which is orthogonal to the first direction and the second direction.

In such a configuration, an interval between the first nozzle array and the second nozzle array in the second direction is minimized. Consequently, it is possible to reduce the size of a cap for maintenance which covers both of the first and second nozzle arrays, so that downsizing of an apparatus body incorporating the liquid ejection head can also be carried out effectively.

The nozzles are arranged with a constant interval. Here, it is preferable that the first nozzle array and the second nozzle array are shifted relative to each other in the first direction by a half of the constant interval.

In such a configuration, when the first nozzle array and the second nozzle array are viewed from the second direction, the nozzle density per a unit area can be doubled. Accordingly, precise ejecting operation can be established.

Preferably, the liquid ejection head further comprises a holder, formed with a positioning member which determines positions of the liquid ejection units. In such a configuration, accurate arrangement of the liquid ejection units can be established.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Figure 1:
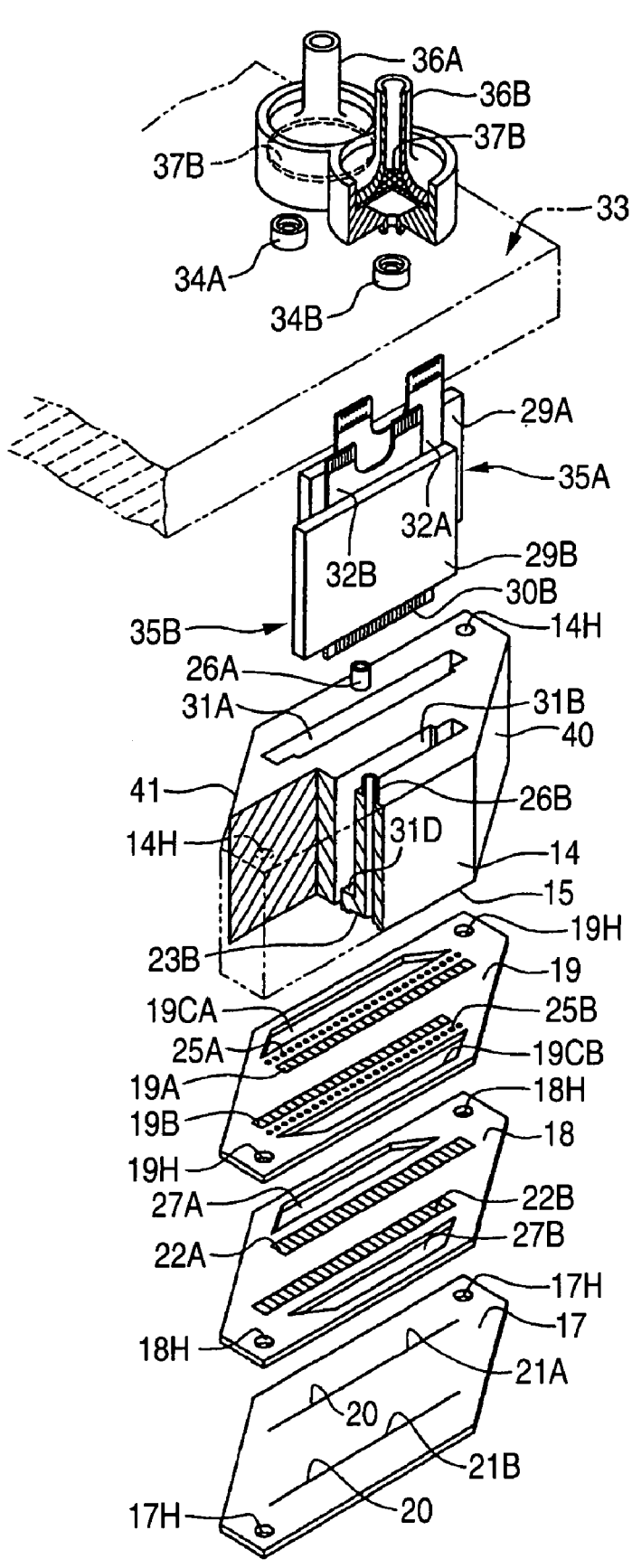
FIG. 1 is an exploded perspective view showing a liquid ejection head according to a first embodiment of the invention.

Preferred embodiments of the invention will be described below in detail with reference to the accompanying drawings.

A liquid ejection head according to the invention can be applied to cases for ejecting various kinds of liquid as described above. As a representative example, the embodiments shown in the drawings are for a recording head incorporated in an ink jet recording apparatus.

Figure 10:
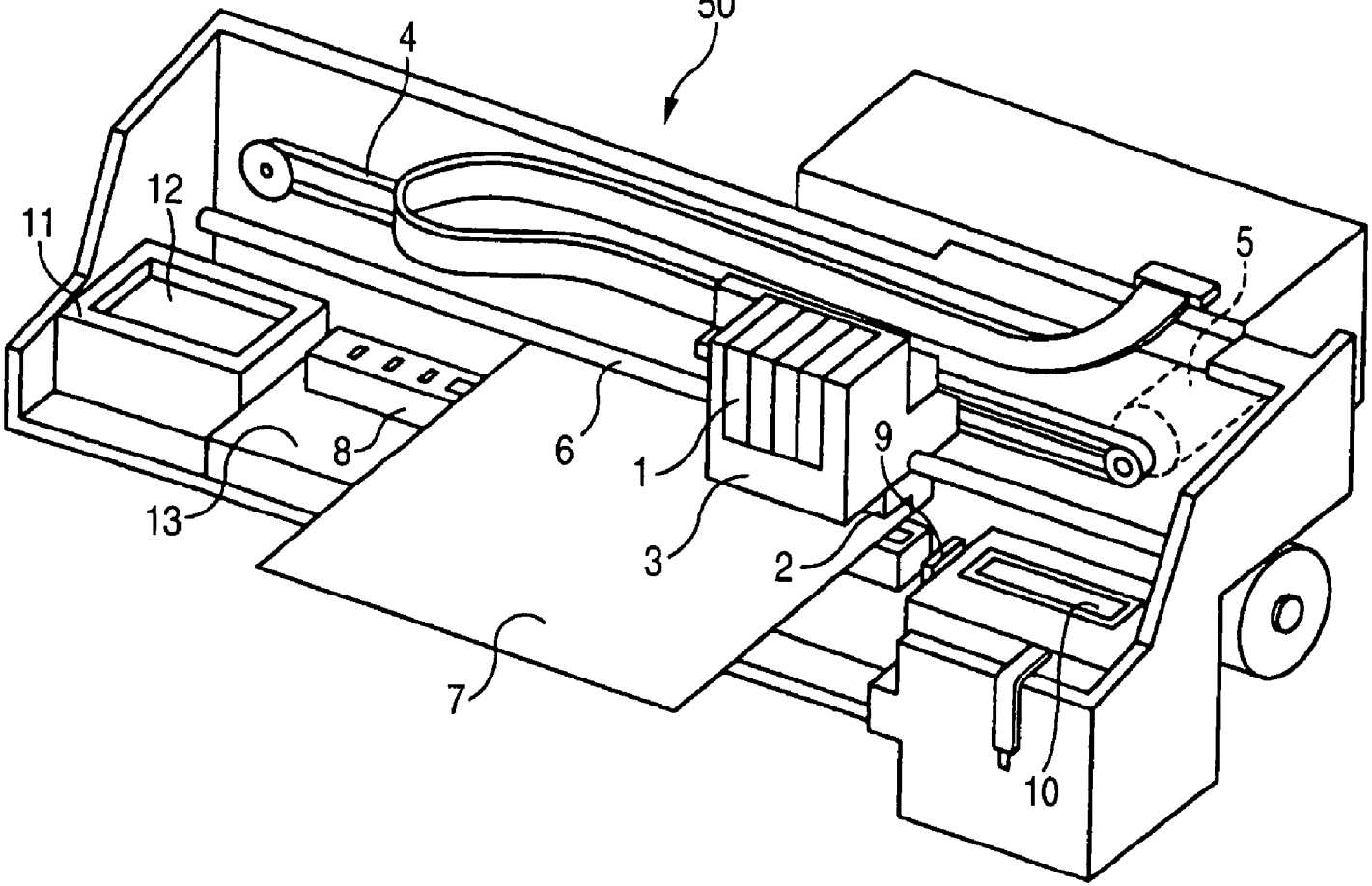
FIG. 10 is a perspective view showing an ink jet recording apparatus.
Figure 11:
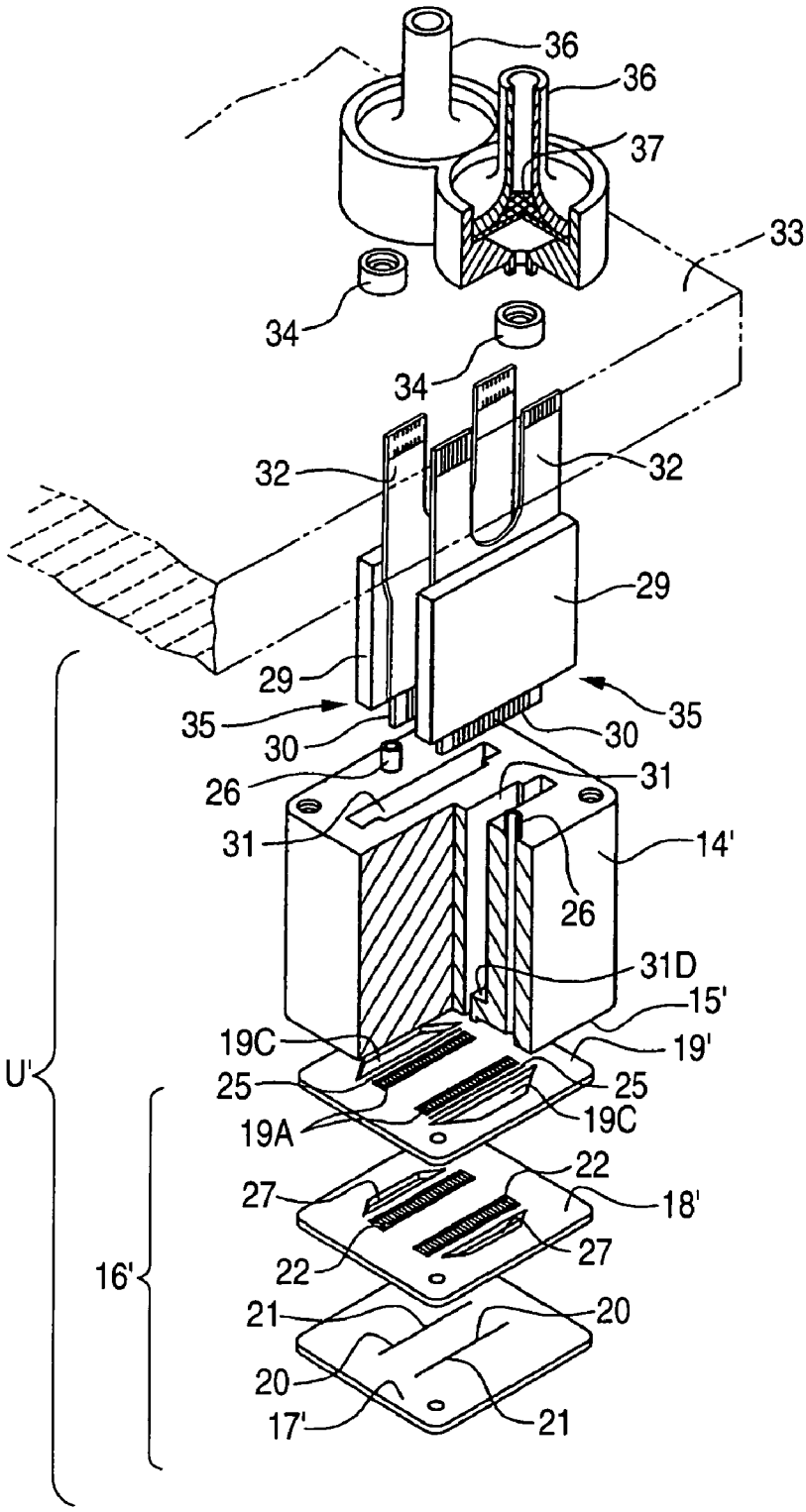
FIG. 11 is an exploded perspective view showing a related-art ink ejection head.
Figure 12:
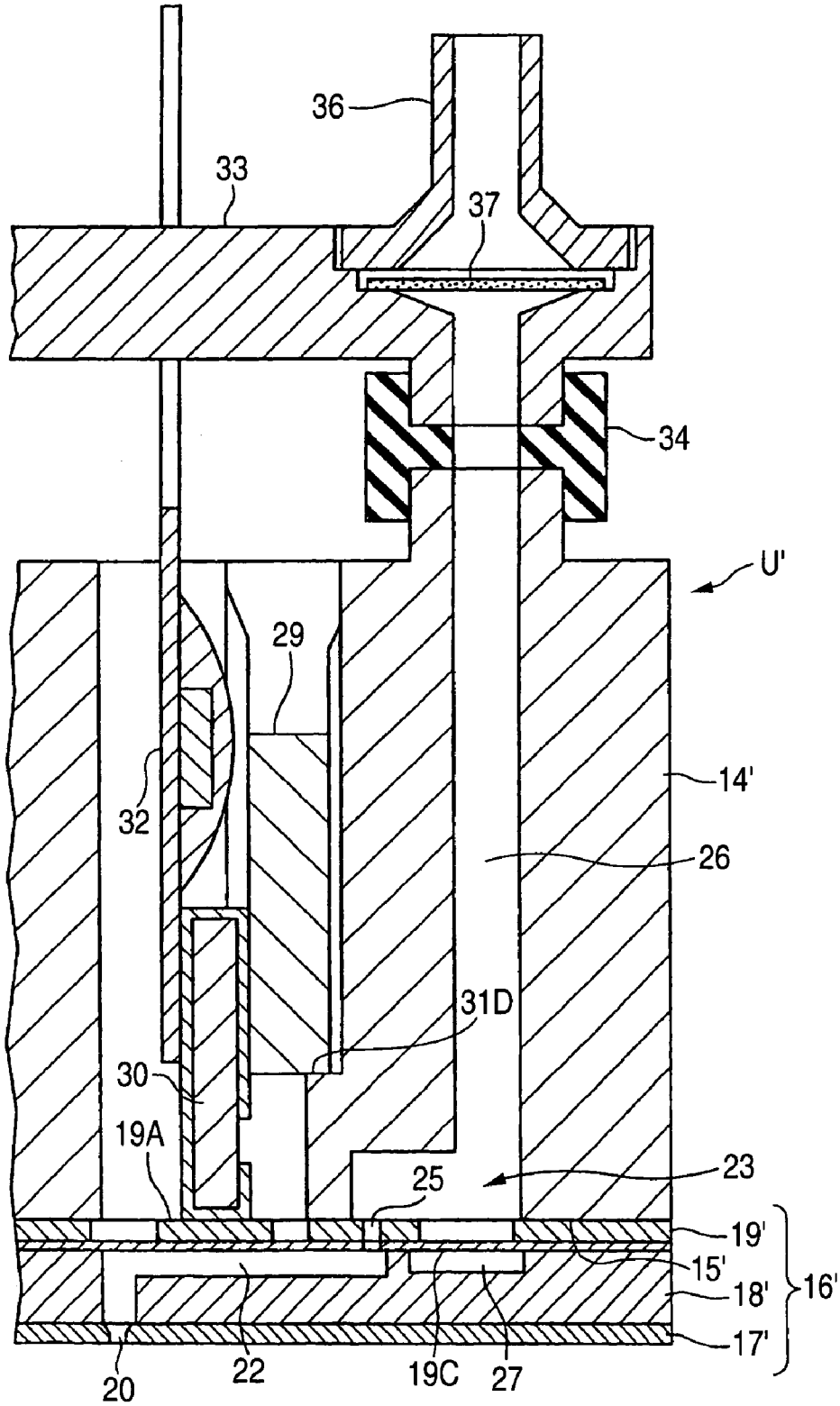
FIG. 12 is a sectional view of the related-art ink ejection head.
Figure 13A:
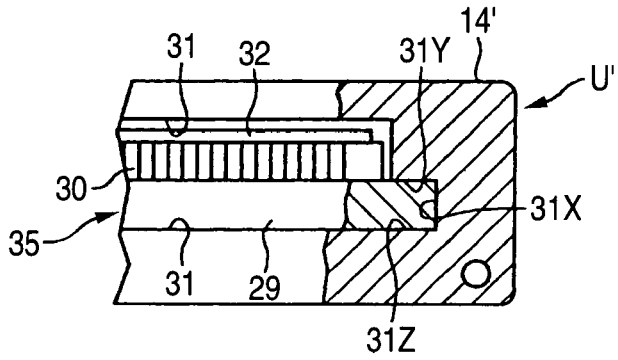
FIG. 13A is a partially-sectional plan view showing a head case of the related-art ink ejection head.
Figure 13C:
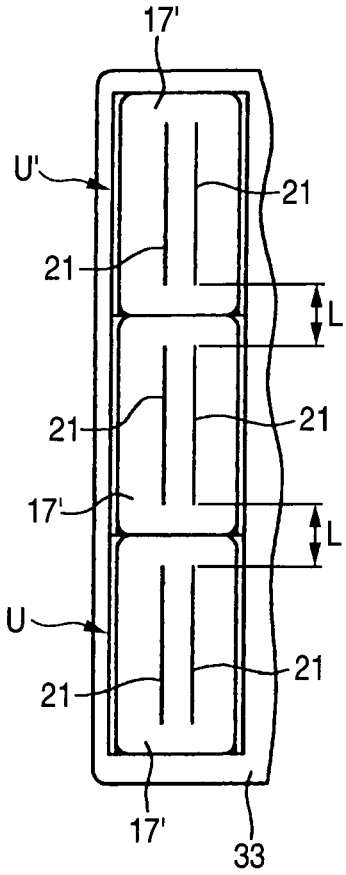
FIG. 13C is a plan view showing a first example in which a plurality of the related-art ink ejection heads are arranged.
Figure 13B:
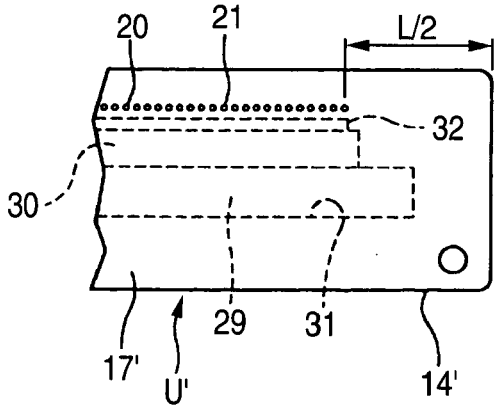
FIG. 13B is a plan view showing the head case from a nozzle plate side.
Figure 14:
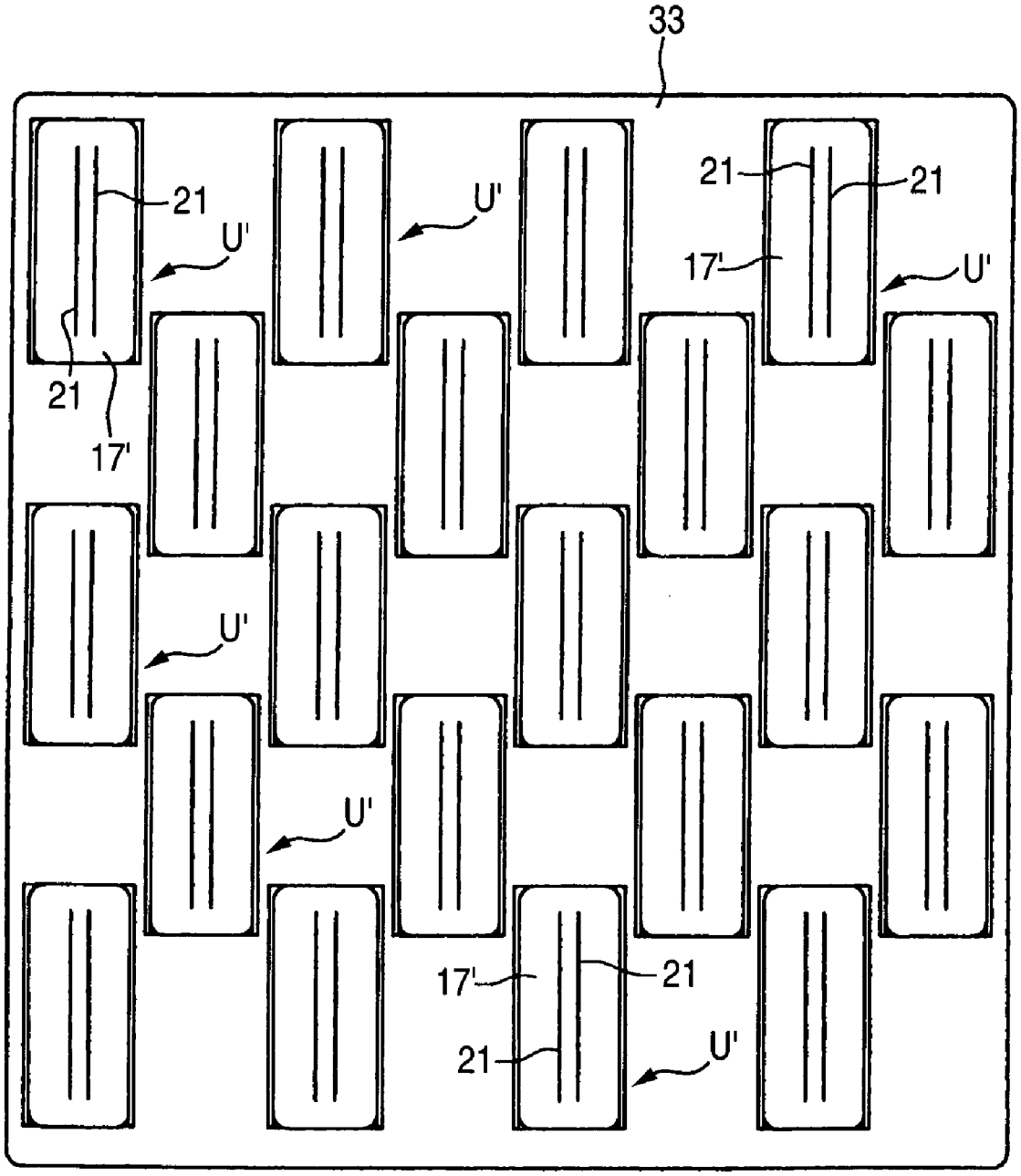
FIG. 14 is a plan view showing a second example in which a plurality of the related-art ink ejection heads are arranged.

An apparatus body, that is, an ink jet recording apparatus 50 according to the invention is of a type shown in FIG. 10.

The structure of a liquid ejection unit which is an essential component of the liquid ejection head according to the invention is shown in FIG. 1. An ink ejection unit U is provided with a first nozzle array 21A and a second nozzle array 21B shifted from the first nozzle array 21A in the extending direction thereof. The length of the first nozzle array 21A is equal to that of the second nozzle array 21B. The first nozzle array 21A and the second nozzle array 21B extend in parallel to each other. The structure of each portion which will be described below corresponds to both of the nozzle arrays 21A and 21B.

Figure 2:
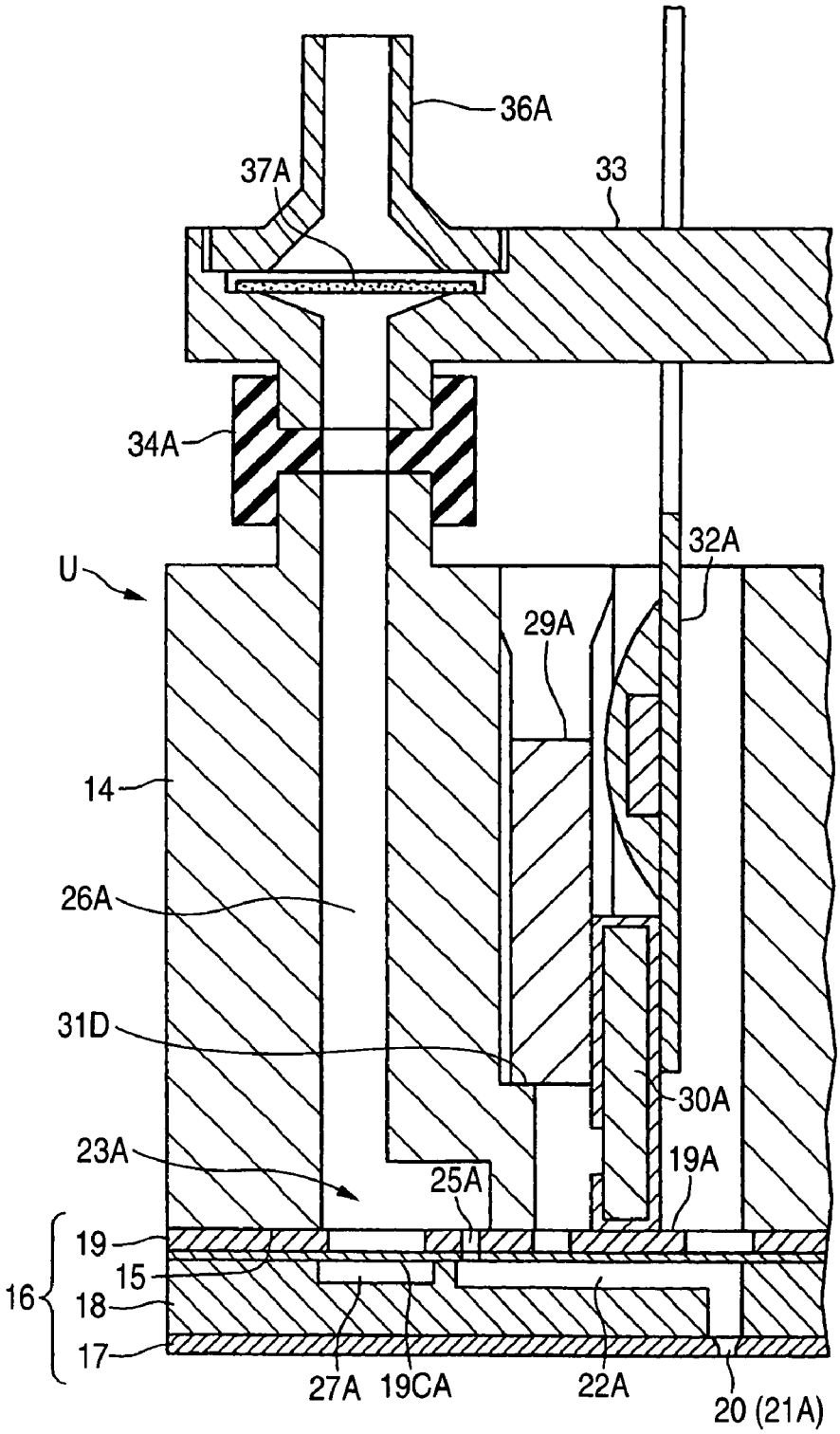
FIG. 2 is a sectional view of the liquid ejection head of the first embodiment.

In FIGS. 1 and 2, the ink ejection unit U is constituted by a head case 14 and a channel unit 16 fixed to a surface 15 of the head case 14 with an adhesive. The channel unit 16 is constituted by laminating and bonding a nozzle plate 17, a channel forming substrate 18 and a sealing plate 19 also serving as a vibrating plate. FIG. 2 is a partial sectional view in which only the second nozzle array 21A side portion is taken away.

The nozzle plate 17 is formed by a stainless plate, and is provided with a large number of nozzle orifices 20 arrayed in an orthogonal direction to the sheet of FIG. 2, thereby forming the first nozzle array 21A and the second nozzle array 21B.

In the following description, the reference numeral with "A" corresponds to the first nozzle array 21A and the reference numeral with "B" corresponds to the second nozzle array 21B.

The channel forming substrate 18 is formed by a monocrystalline silicon substrate, and formed with first pressure generating chambers 22A and second pressure generating chambers 22B to be communicated with the nozzle orifices 20, and a first damper concave portion 27A and a second damper concave portion 27B communicating with the atmosphere (not shown) which are formed by anisotropic etching. In the head case 14, first and second ink reservoirs 23A and 23B communicating with ink supply tubes 26A and 26B are formed, which are to be communicated with the first pressure generating chambers 22A and the second pressure generating chambers 22B through ink supply ports 25A and 25B formed in the sealing plate 19.

Figure 5A:
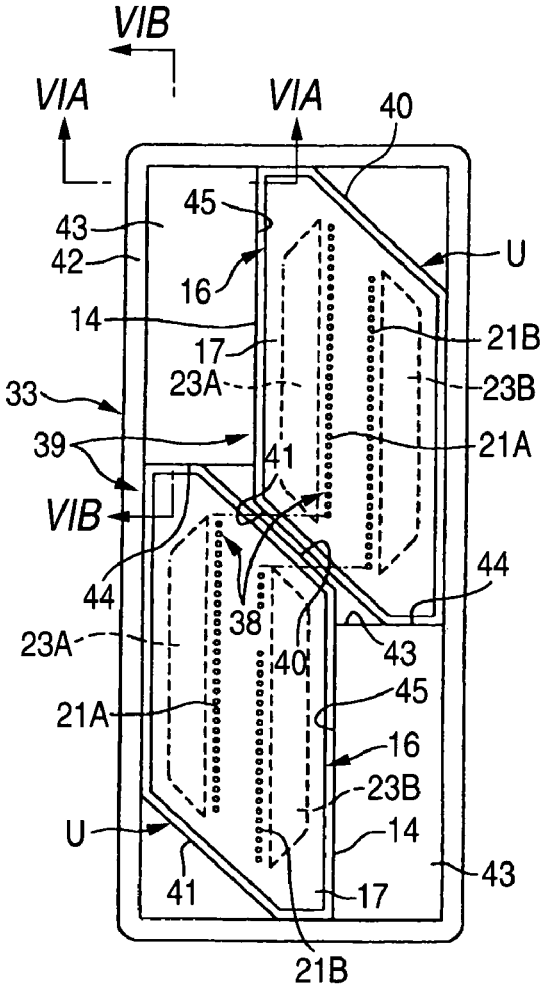
FIG. 5A is a plan view as seen from a nozzle plate, showing a state that the ink ejection heads of the first embodiment are mounted in a head holder.
Figure 5B:
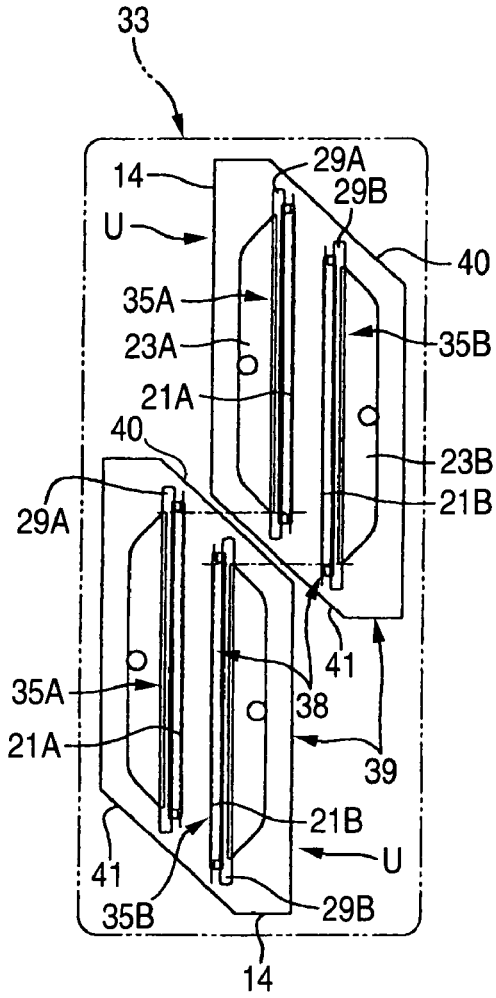
FIG. 5B is a plan view as seen from a head case, showing a state that the ink ejection heads of the first embodiment are mounted in the head holder.
Figure 6A:
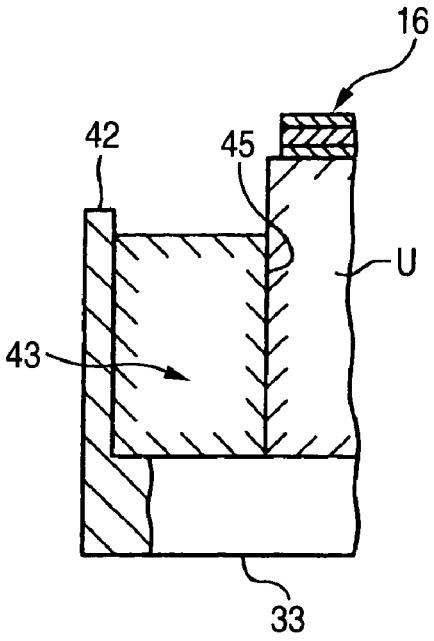
FIG. 6A is a sectional view taken along [6A]—[6A] in FIG. 5A.
Figure 6B:
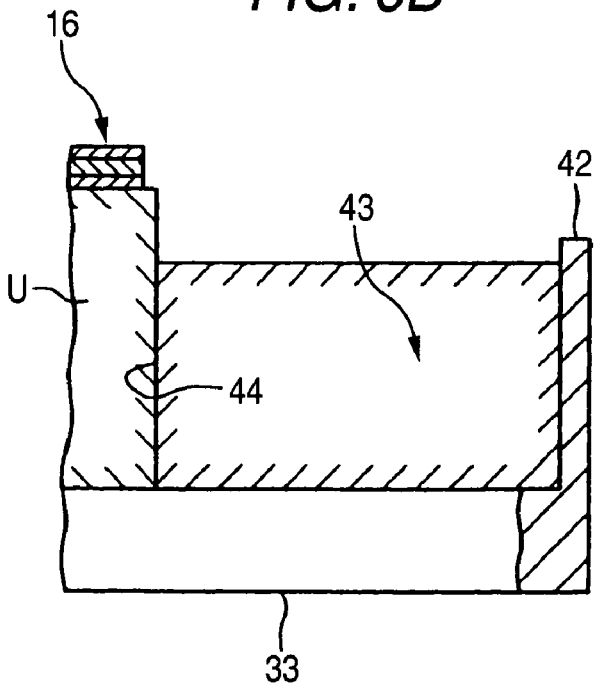
FIG. 6B is a sectional view taken along [6B]—[6B] in FIG. 5A.

As shown in FIG. 5A, the first nozzle array 21A and the second nozzle array 21B are arranged in the nozzle plate 17 so as to be placed between the first ink reservoir 23A and the second ink reservoir 23B. Accordingly, an interval between the first nozzle array 21A and the second nozzle array 21B is minimized, so that the sizes of a capping device 10 and an opening 12 in a flushing box 11 for covering both of the first and second nozzle arrays 21A and 21B can be reduced. It is advantageous to downsize the apparatus body.

The sealing plate 19 is formed by laminating a resin film and a stainless plate, and island portions 19A and 19B of the stainless plate are formed on the back faces of portions corresponding to the pressure generating chambers 22A and 22B. Moreover, there are provided compliance portions 19CA and 19CB which are formed by only a resin film having almost the same contours as those of the first and second ink reservoirs 23A and 23B.

The head case 14 is an injection molded product formed by a thermosetting resin or a thermoplastic resin, and the ink supply tubes 26A and 26B for introducing ink to the first ink reservoir 23A and the second ink reservoir 23B are opened on the surface 15. The first and second damper concave portions 27A and 27B which have almost coincident shapes with the shapes of the first ink reservoir 23A and the second ink reservoir 23B are formed in portions corresponding to both of the ink reservoirs 23A and 23B.

Piezoelectric vibrators 30A and 30B are respectively fixed on fixing boards 29A and 29B to form piezoelectric vibrator units 35A and 35B which are to be accommodated in chambers 31A and 31B. Each of the piezoelectric vibrators 30A and 30B is a vibrator element of longitudinal vibration mode which expands or contracts in its longitudinal direction in accordance with input of a drive signal to apply pressure fluctuation in the associated one of the first pressure generating chambers 22A and the second pressure generating chambers 22B.

The first and second damper concave portions 27A and 27B are spaces formed by the sealing plate 19 for sealing openings on the lower side of the first and second ink reservoirs 23A and 23B and a concave portion provided in the channel forming substrate 18, and serve to absorb pressure fluctuation in the first and second ink reservoirs 23A and 23B at time of the discharge of an ink drop by the deformation of the compliance portions 19CA and 19CB. During the deformation of the compliance portions 19CA and 19CB, air in the first and second damper concave portions 27A and 27B f is released from an air releasing hole (not shown) to the outside, thereby preventing pressure rising in the first and second damper concave portions 27A and 27B.

The ink ejection unit U having the structure described above is assembled in the following manner, for example. An adhesive is first applied onto the surface 15 of the head case 14 in order to prevent ink from flowing into the ink supply tubes 26A and 26B and the chambers 31A and 31B or an adhesive sheet formed by punching to have a predetermined shape is stuck to the surface 15. The channel unit 16 preassembled by bonding with an adhesive is then mounted thereon. Subsequently, heating is carried out to have a temperature of approximately 40 to 100° C. and pressing is performed if necessary, thereby fixing the channel unit 16 to the head case 14.

On the other hand, the piezoelectric vibrator units 35A and 35B formed by fixing the piezoelectric vibrators 30A and 30B to the fixing boards 29A and 29B are prepared and an adhesive is applied onto the tip ends of the piezoelectric vibrators 30A and 30B. Next, the head case 14 is inverted such that the channel unit 16 faces downward, and the piezoelectric vibrator units 35A and 35B are accommodated in the chambers 31A and 31B and are bonded and fixed thereto, respectively. In this state, the tip ends of the piezoelectric vibrators 30A and 30B are bonded and fixed to the sealing plate 19 of the channel unit 16 and the fixing boards 29A and 29B are finally fixed to the head case 14 so that the ink ejection unit U is finished.

In the ink ejection unit U, a driving signal generated in a driving circuit (not shown) is input to each of the piezoelectric vibrators 30A and 30B through flexible cables 32A and 32B, thereby expanding or contracting the piezoelectric vibrators 30A and 30B. By the expansion and contraction of the piezoelectric vibrators 30A and 30B, the island portions 19A and 19B of the sealing plate 19 are vibrated to change pressure in the first and second pressure generating chambers 22A and 22B, thereby discharging ink in the first and second pressure generating chambers 22A and 22B as ink drops from the nozzle orifices 20.

The ink ejection unit U is attached to a plate-shaped head holder 33 through coupling members 34A and 34B. Pipe-shaped connectors 36A and 36B are attached to the head holder 33 to lead ink from the ink cartridge 1 to the ink ejection unit U. The connectors 36A and 36B may be ink supply needles (not shown) to pierce the inside of the ink cartridge 1 when the ink cartridge 1 is attached to the head holder 33.

Filters 37A and 37B are provided on the downstream side of the connectors 36A and 36B and serve to catch impurities in the ink and to prevent the impurities from flowing into the ink supply tubes 26A and 26B.

In the assembling process as described the above, reference holes are practically used. The nozzle plate 17 is formed with reference holes 17H. The channel forming substrate 18 is formed with reference holes 18H. The sealing plate 19 is formed with reference holes 19H. The head case 14 is formed with reference holes 14H. The reference holes 17H, 18H and 19H are used for inserting a positioning pin (not shown) to carry out positioning when the nozzle plate 17, the channel forming substrate 18 and the sealing plate 19 are laminated to finish the channel unit 16. Accordingly, precision in the assembly of the channel unit 16 is properly maintained so that the channel unit 16 can discharge ink correctly.

Also when the channel unit 16 is to be bonded to the surface 15 of the head case 14, the reference holes 17H, 18H and 19H set in a communicating state with the channel unit 16 are caused to correspond to the reference hole 14H on the head case 14 side and both of them are thus integrated by using a positioning pin (not shown). Unified bolt holes (not shown) are formed on the nozzle plate 17, the channel forming substrate 18, the sealing plate 19 and the head case 14 respectively, and the ink ejection unit U is fixed to the head holder 33 with bolts (not shown) penetrating through the bolt holes. Also when the ink ejection unit U is to be fixed to the head holder 33, the reference hole 14H can be utilized. In this case, the practical use can be carried out also when the reference hole 14H of the head case 14 is caused to correspond to the reference hole or the reference pin (not shown) on the head holder 33 side to normally set a positional relationship between a plurality of ink ejection units U.

By arranging the plural ink ejection units U in a predetermined manner, a single unit 39 is constituted so as to include nozzle groups 38 forming elongated nozzle arrays.

Since the first nozzle array 21A and the second nozzle array 21B are shifted from each other in the extending direction thereof as described above, all of the first and second pressure generating chambers 22A and 22B, the first and second damper concave portions 27A and 27B, the first and second ink reservoirs 23A and 23B, the island portions 19A and 19B, the compliance portions 19CA and 19CB, and the chambers 31A and 31B are correspondingly shifted from each other in the same manner as the nozzle arrays.

Corresponding to the shift arrangement as described the above, oblique faces 40 and 41 are formed on the head case 14 by chamfering diagonal corners of the head case 14, so that the head case 14 has a substantially parallelepiped cross section relative to the depth direction of the chambers 31A and 31B.

Correspondingly, the contours of the nozzle plate 17, the channel forming substrate 18 and the sealing plate 19 are made identical with the parallelepiped cross section of the head case 14.

Two of the ink ejection units U thus configured are combined to constitute the single unit 39 as shown in FIG. 5A. The first nozzle arrays 21A of the two ink ejection units U constitute a nozzle group 38 for ejecting one color of ink. The second nozzle arrays 21B of the two ink ejection units U constitute a nozzle group 38 for ejecting one color of ink. The color of ink ejected from the respective nozzle groups 38 may be identical or different.

Figure 3:
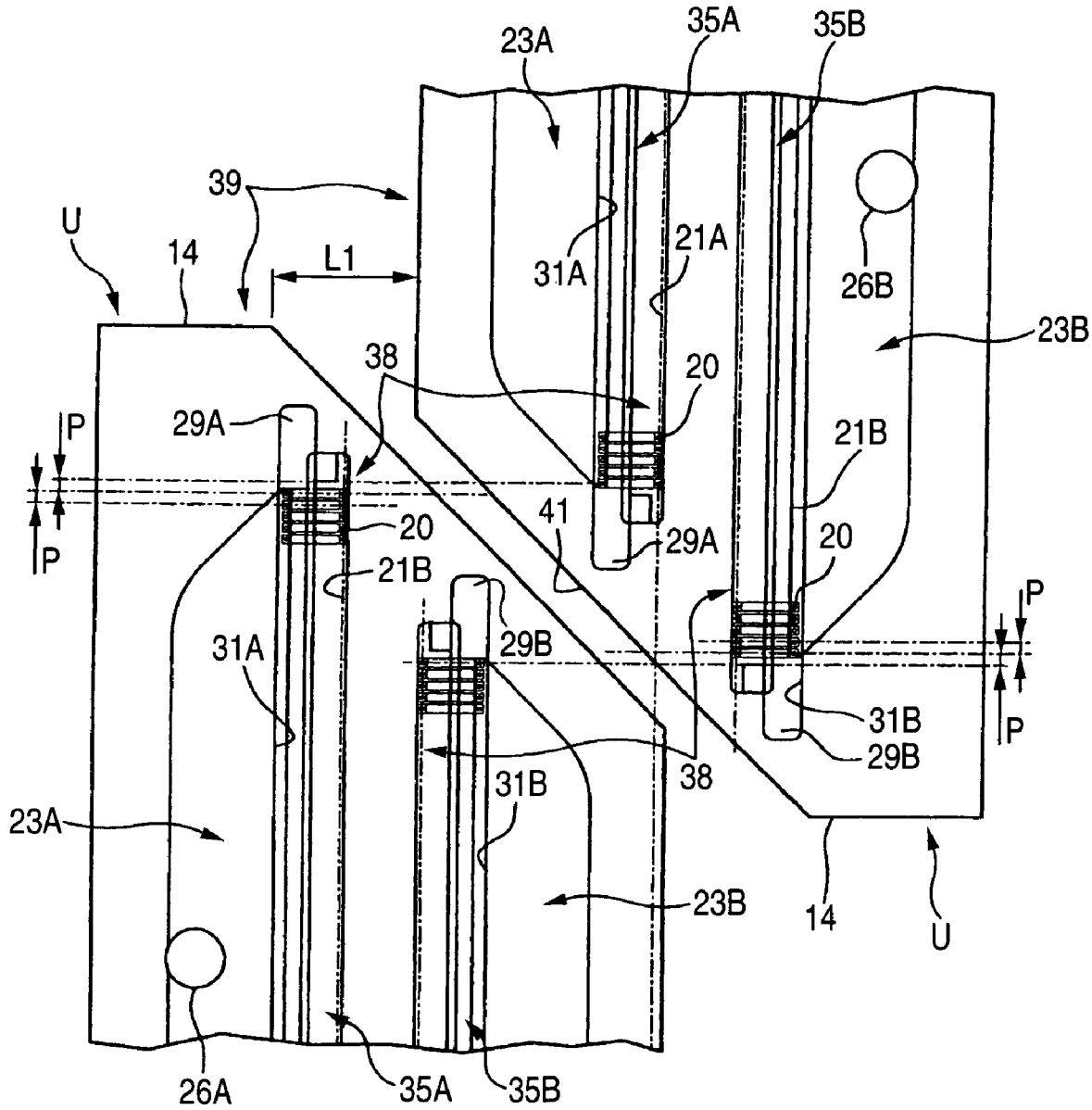
FIG. 3 is an enlarged plan view showing an overlapping portion of two liquid ejection heads of the first embodiment.

FIG. 3 is a plan view showing the ink ejection unit U seen from the piezoelectric vibrator unit 35A and 35B sides. For easy understanding, the first and second ink reservoirs 23A and 23B provided in portions which cannot be seen are also shown perspectively in a solid line.

The ink ejection units U are partially overlapped in the primary scanning direction such that the oblique face 40 of one ink ejection unit U and the oblique face 41 of the other ink ejection unit U are faced each other. The overlapping length is denoted by L1 in FIG. 3. Accordingly, the nozzle array 21A of one ink ejection unit U and the nozzle array 21A of the other ink ejection unit U are made continuous when viewed from the primary scanning direction.

Figure 4A:
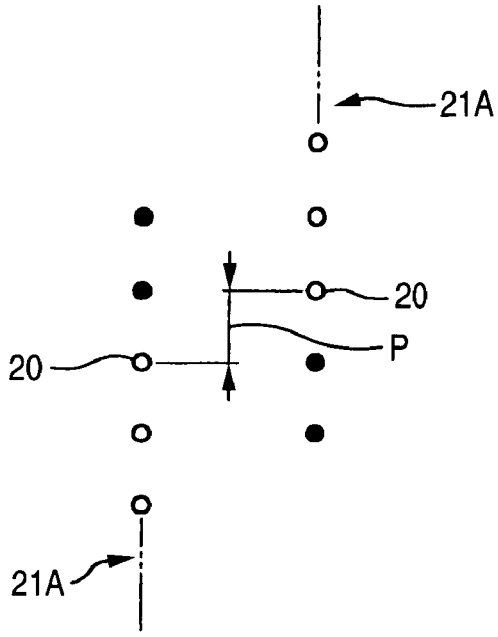
FIG. 4A is a schematic diagram showing nozzles in the overlapping portion.

As shown in FIG. 4A, when viewed from the primary scanning direction, an interval between the nozzle orifice at the end of the one nozzle array 21A and the nozzle orifice at the end of the other nozzle array 21A is made identical with the interval (pitch) P of the nozzle orifices 20 in the respective nozzle arrays 21A.

As indicated by black circles in FIG. 4A, there may be a case where there are nozzle orifices not to be used to stabilize the ejection characteristics. In such a case, the ink ejection units U are arranged such that the nozzle arrays 21A are overlapped in the secondary scanning direction. More specifically, an interval between the nozzle orifice at the end of the one nozzle array 21A to be used and the nozzle orifice at the end of the other nozzle array 21A to be used is made identical with the interval (pitch) P of the nozzle orifices 20 in the respective nozzle arrays 21A to form a continuously elongated nozzle orifice array when viewed from the primary scanning direction.

Figure 4B:
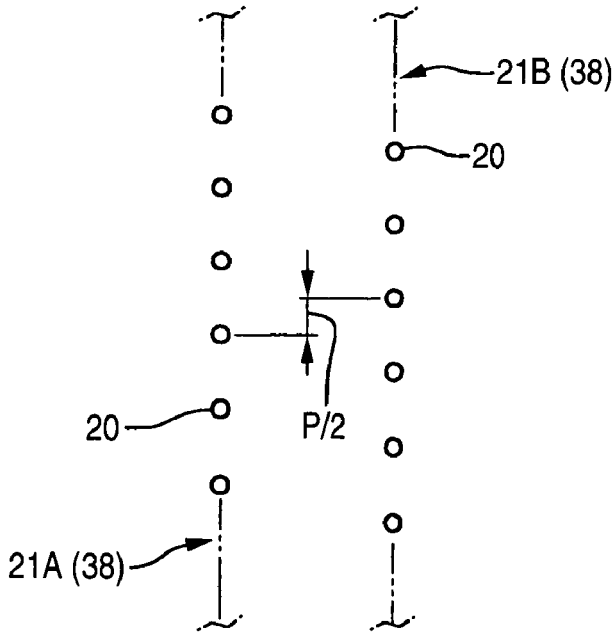
FIG. 4B is a schematic diagram showing shifted nozzles in the liquid ejection head of the first embodiment.

As shown in FIG. 4B, the nozzle array 21A and the nozzle array 21B are shifted from each other such that an interval between the nozzle orifice 20 in the nozzle array 21A and the nozzle orifice 20 in the nozzle array 21B becomes a half of the pitch P of the nozzle orifices, when viewed from the primary scanning direction. As a result, the substantial pitch of the nozzle orifices 20 in the secondary scanning direction can be made smaller when viewed from the primary scanning direction.

According to such a configuration, the number of ink droplets ejected on a unit area in the recording medium 7 can be increased, thereby realizing quality-enhanced recording. Further, in a case where the half pitch (P/2) is made to be n-times (n is an integer) of a recording resolution, it is possible to reduce the stroke number of the ink ejection head 2 in the primary scanning direction, thereby reducing time and power required for the recording.

As shown in FIGS. 5A through 6B, the head holder 33 is formed with a positioning wall 42 at the periphery thereof. The ink ejection unit U is attached to the head holder 33 such that the outer peripheral face of the ink ejection unit U is brought into contact with an inner face of the positioning wall 42. Accordingly, the relative positions of the ink ejection units U thus attached are set accurately, and the relative positions of the first nozzle arrays 21A and the second nozzle arrays 21B can be maintained with high precision.

Furthermore, block-shaped positioning protrusions 43 are integrally formed with the head holder 33 at the attachment side of the ink ejection unit U. Each of the protrusions 43 is provided with a reference face 44 for restraining the movement of each unit U in the secondary scanning direction and a reference face 45 for restraining the movement of the unit U in the primary scanning direction. The outer peripheral face of the ink ejection unit U abuts on the reference faces 44 and 45.

By the structure, the units 39 including the nozzle groups 38 can be formed with high precision and excellent ejection of ink drops can be attained. Further, the above described half pitch (P/2) can be secured for the nozzle groups 38.

By shifting the first and second nozzle arrays 21A and 21B from each other, it is possible to form the oblique faces 40 and 41 in the external shape portion of the ink ejection unit U. The oblique faces 40 and 41 thus obtained are opposed to each other to constitute the single unit 39 so that both of the ink ejection units U overlap in the oblique face 40 and 41 portions, so that a dimension occupied by the single unit 39 in the primary scanning direction can be reduced corresponding to the overlapped dimension.

In a case where the ink ejection head 2 comprises a plurality of single units 39, the downsizing effect can be further enhanced. Furthermore, the nozzle arrays 21A, and 21B of the two ink ejection units U form the nozzle groups 38 the effective lengths of which are apparently elongated, so that the ink drops can be ejected into a determined region in a short time period.

Although the elongation of the effective length of the nozzle group can be attained, increase in the dimension of the single unit 39 in the primary scanning direction. Accordingly, it is possible to obtain an ink ejection unit U which is compact relative to the primary scanning direction, while securing enough length of the nozzle group 38 in the secondary scanning direction.

Since the oblique faces 40 and 41 of each ink ejection unit U are uniformly extending in parallel with the depth direction of the chambers 31A and 31B, in a case where a plurality of ink ejection units U are arranged to constitute a single unit 39, the units U can be arranged in order based on parallelograms. Accordingly, it is possible to obtain the nozzle groups 38 in which the nozzle array 21A (21B) of one unit U and the nozzle array 21A (21B) of another unit U are correctly made continuous when viewed from the primary, scanning direction.

The width of fixing boards 29A and 29B are set to have a dimension larger than the nozzle arrays 21A and 21B so that the close contact with the internal faces of the chambers 31A and 31B can be achieved. Even in such a configuration, since one end of the fixing board 29A (29B) of one unit U and one end of the fixing board 29A (29B) of another unit U are overlapped in the secondary scanning direction as shown in FIG. 3, it is possible to obtain the nozzle groups 38 in which the nozzle array 21A (21B) of one unit U and the nozzle array 21A (21B) of another unit U are correctly made continuous when viewed from the primary scanning direction.

Since the lengths of the first nozzle array 21A and the second nozzle array 21B in each liquid ejection unit U are equal to each other, the lengths of the shifted segment appearing both ends of the nozzle arrays 21A and 21B can be equalized. Accordingly, the above described parallelogram arrangement can be easily attained. Incidentally, the lengths of the first nozzle array 21A and the second nozzle array 21B are determined as a length at which ink ejection characteristics is most stable.

According to the above-described overlapping configuration of the two liquid ejection units U in the primary scanning direction (i.e., the oblique face 40 of one unit U and the oblique face 41 of the other unit U), it is possible to obtain a single unit 39 having a compact width in the primary scanning direction which is smaller than the total width of the two ink ejection units U, while securing the elongated lengths of the nozzle groups 38 in the secondary scanning direction.

Since each ink ejection unit U is mounted in the head holder 33 while being brought into contact with the positioning wall 42 and the positioning protrusion 43, a single unit 39 having nozzle groups 38 based on the above-described continuous arrangement and half-pitch arrangement. Stable ink ejection can be performed from the elongated nozzle groups 38.

Figure 7A:
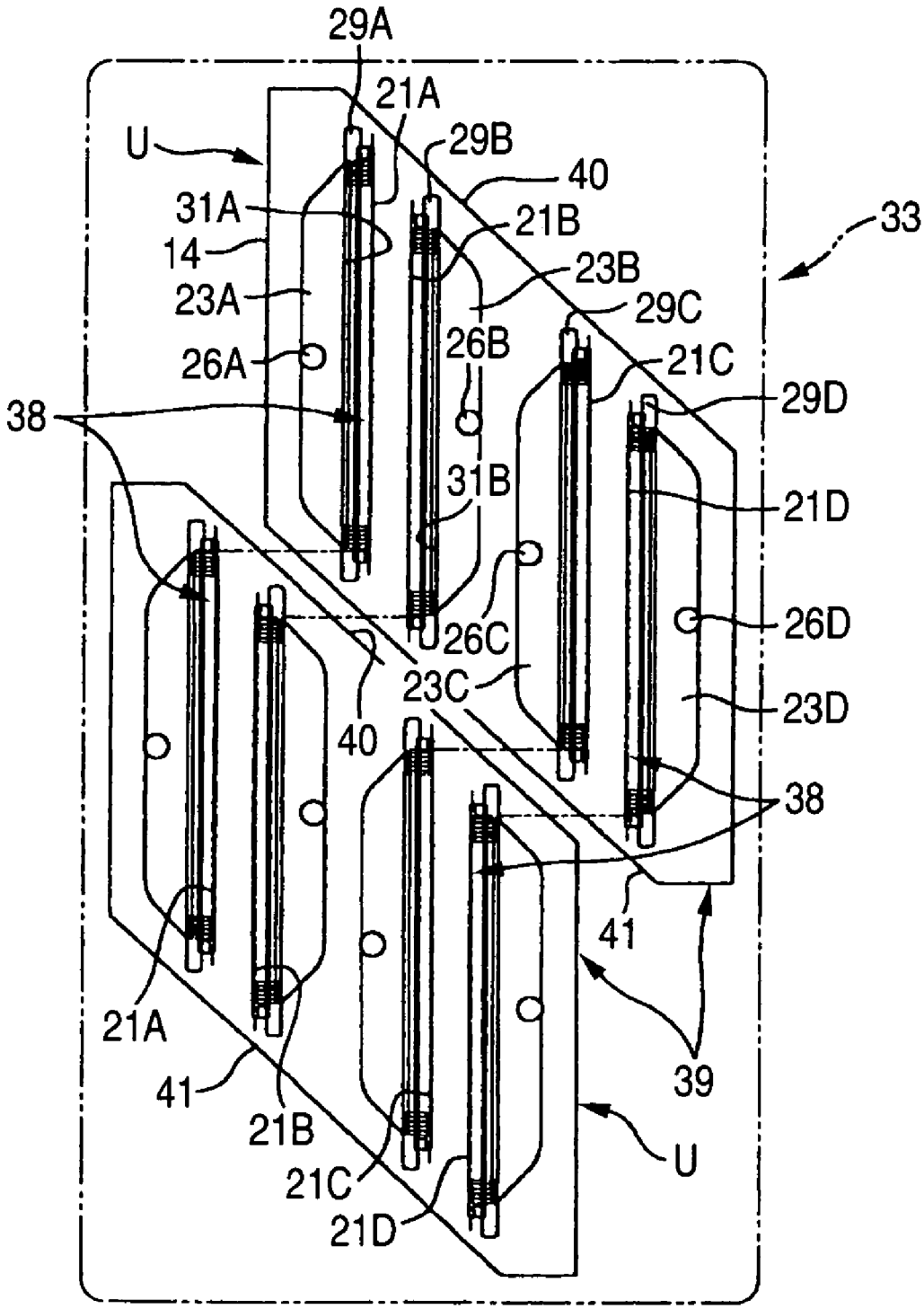
FIG. 7A is a plan view showing a liquid ejection head according to a second embodiment of the invention.
Figure 7B:
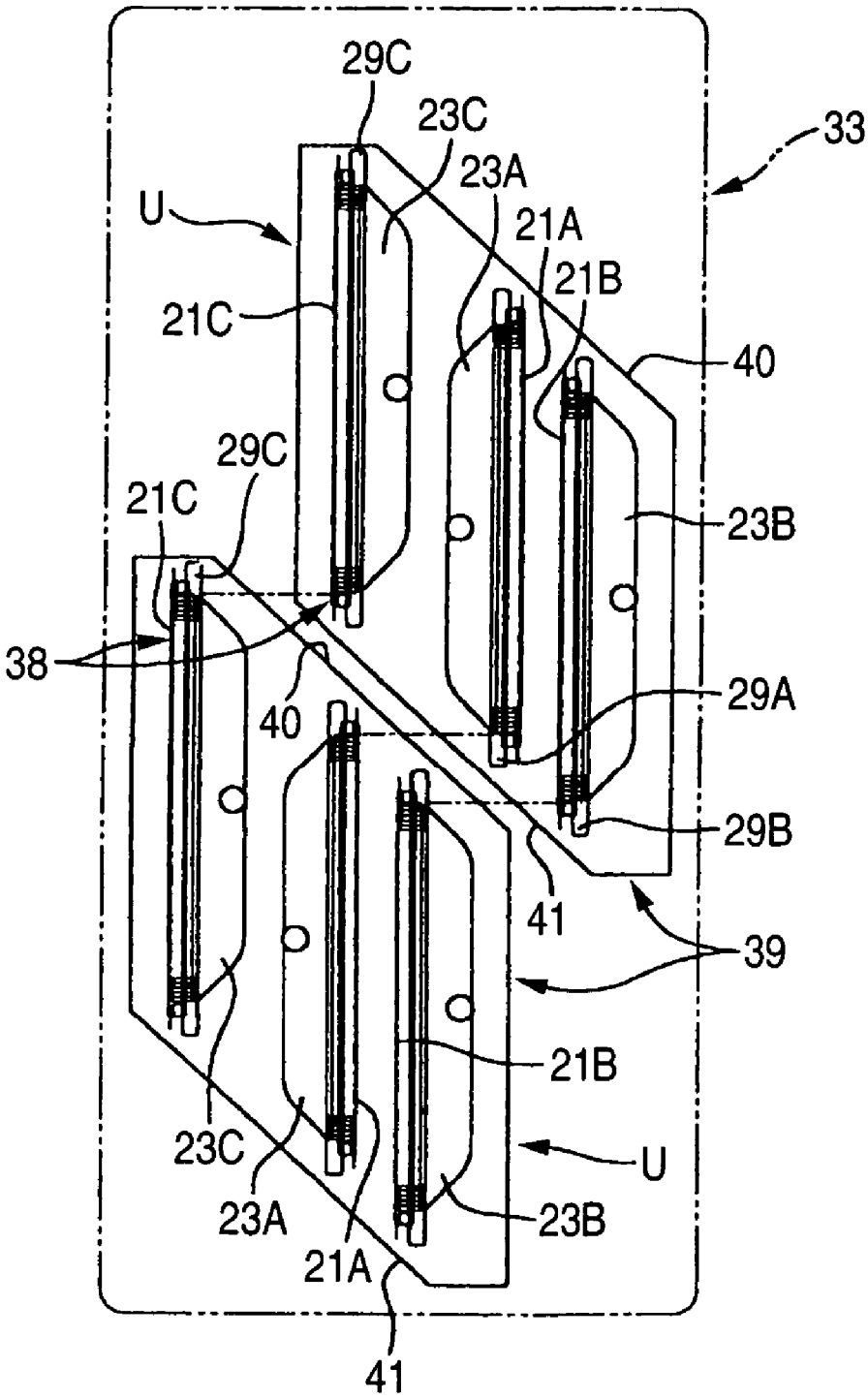
FIG. 7B is a plan view showing a modified example of the liquid ejection head of the second embodiment.

FIGS. 7A and 7B show a liquid ejection head according to a second embodiment of the invention.

In this embodiment, as shown in FIG. 7A, four nozzle arrays 21A, 21B, 21C and 21D are provided in one ink ejection unit U. Such an ink ejection unit U makes a pair so that a single unit 39 is constituted. Correspondingly, four nozzle groups 38 are constituted. An equal shift amount is given to the four nozzle arrays 21A, 21B, 21C and 21D. Consequently, long oblique faces 40 and 41 are constituted. Of course, the number of the nozzle arrays provided in each ink ejection unit U may be three as shown in FIG. 7B.

In the above configuration, different colors of ink may be ejected from the respective nozzle groups 38 to perform printing which is rich in color variation. On the other hand, the dimension increase in the primary scanning direction is relatively low although the effective nozzle length in the secondary scanning direction is made double. Any other advantages are the same as explained in connection with the first embodiment.

Figure 8:
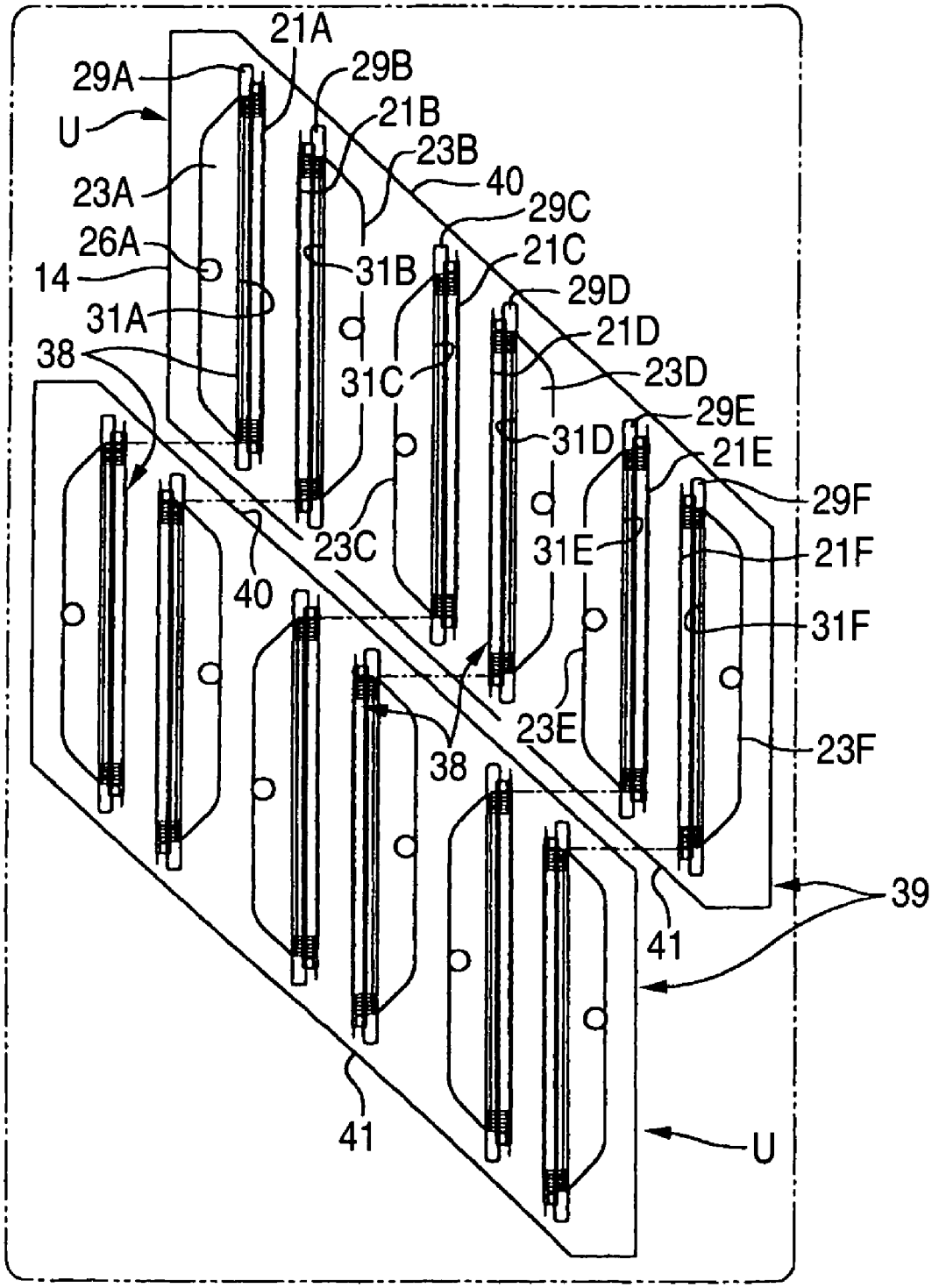
FIG. 8 is a plan view showing a liquid ejection head according to a third embodiment of the invention.

FIG. 8 shows a liquid ejection head according to a third embodiment of the invention.

In this embodiment, six nozzle arrays 21A, 21B, 21C, 21D, 21E and 21F are provided in one ink ejection unit U. Such an ink ejection unit U makes a pair so that a single unit 39 is constituted. Correspondingly, six nozzle groups 38 are constituted. An equal shift amount is given to the six nozzle arrays 21A, 21B, 21C, 21D, 21E and 21F. Consequently, long oblique faces 40 and 41 are constituted. Others are the same as those in each of the embodiments and the same portions have the same reference numerals.

In the above configuration, different colors of ink may be ejected from the respective nozzle groups 38 to perform printing which is rich in color variation. On the other hand, the dimension increase in the primary scanning direction is relatively low although the effective nozzle length in the secondary scanning direction is made double. Any other advantages are the same as explained in connection with the first embodiment.

Figure 9:
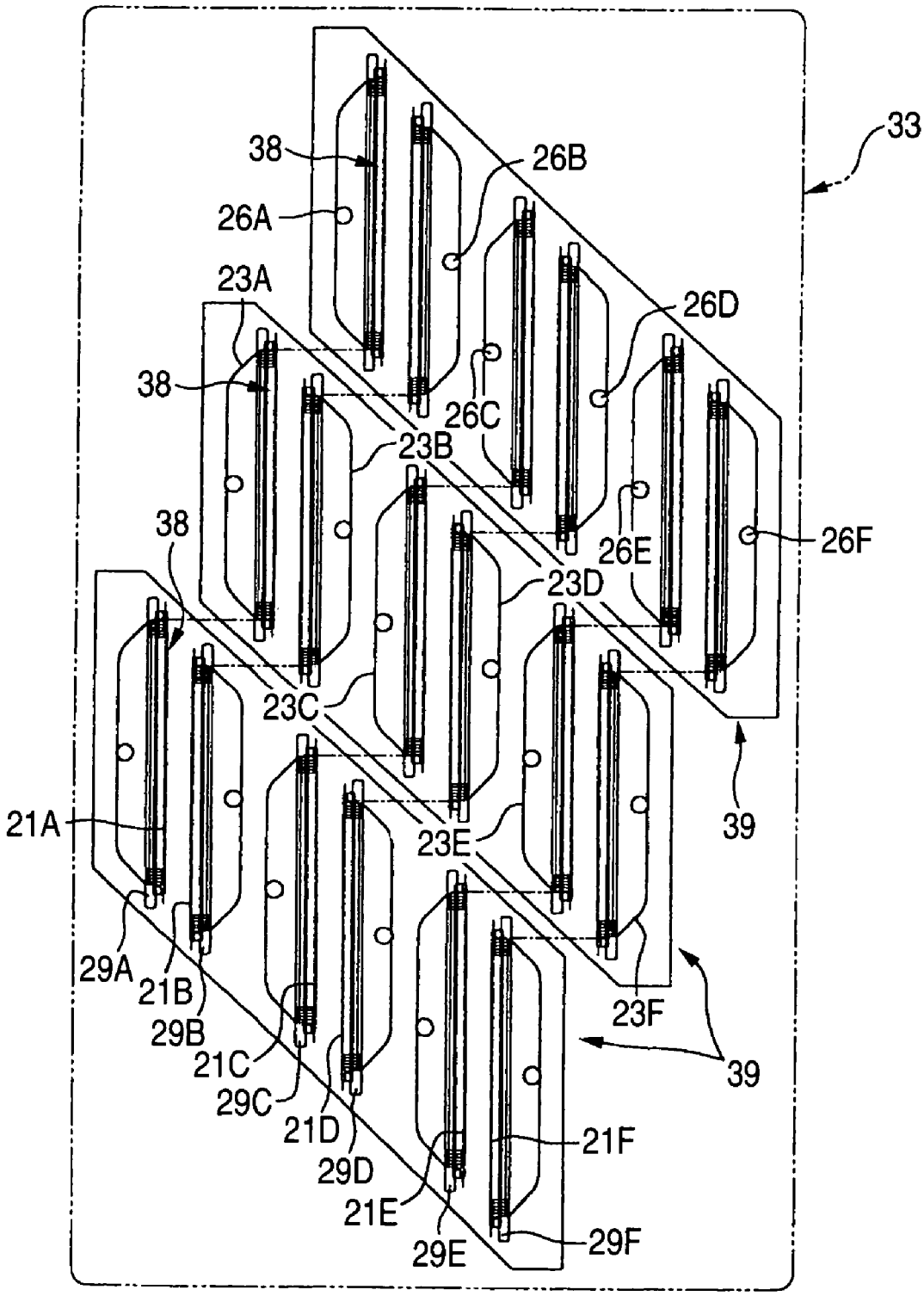
FIG. 9 is a plan view showing a liquid ejection head according to a fourth embodiment of the invention.

FIG. 9 shows a liquid ejection head according to a fourth embodiment of the invention.

In this embodiment, six nozzle arrays 21A, 21B, 21C, 21D, 21E and 21F are provided in one ink ejection unit U. Three of such an ink ejection unit U makes a group so that a single unit 39 is constituted. Correspondingly, six nozzle groups 38 are constituted. An equal shift amount is given to the six nozzle arrays 21A, 21B, 21C, 21D, 21E and 21F. Consequently, long oblique faces 40 and 41 are constituted. Others are the same as those in each of the embodiments and the same portions have the same reference numerals.

By the structure described above, it is possible to constitute a nozzle group 38 which is further elongated. Consequently, a printing speed can be increased still more. On the other hand, the dimension increase in the primary scanning direction is relatively low although the effective nozzle length in the secondary scanning direction is made double. Any other advantages are the same as explained in connection with the above embodiments.

While the embodiments are intended for an ink jet recording apparatus, the liquid ejection head according to the invention is not intended for only ink for the ink jet recording apparatus but glue, manicure and conductive liquid (liquid metal) can be ejected.

While the ink jet recording apparatus using the ink to be one kind of liquid has been described in the embodiments, the invention can also be applied to general liquid ejection heads for ejecting liquid, for example, a recording head to be used in an image recording apparatus such as a printer, a coloring material ejection head to be used in the manufacture of a color filter such as a liquid crystal display, an electrode material ejection head to be used in the formation of an electrode such as an organic EL display or an FED (field emission display) or a bioorganic ejection head to be used in the manufacture of a biochip.

What is claimed is:

1. A liquid ejection head, comprising:

a plurality of liquid ejection units, each comprising:

a casing body, having a first pair of faces extending in a first direction, and a second pair of faces connecting the first pair of faces and extending obliquely relative to the first direction; and a plurality of nozzles, from which liquid droplets are ejected, the nozzles arranged in the first direction to form a first nozzle array and a second nozzle array, wherein:

the liquid ejection units are arranged such that one of the second pair of faces in one of the liquid ejection units and one of the second pair of faces in another one of the liquid ejection units are confronted with each other, so that the liquid ejection units are overlapped in both of the first direction and a second direction which is perpendicular to the first direction;

the first nozzle array in one of the liquid ejection units and the first nozzle array in another one of the liquid ejection units constitute a first nozzle group, which is continuous as viewed from the second direction, for ejecting a first kind of liquid; and the second nozzle array in one of the liquid ejection units and the second nozzle array in another one of the liquid ejection units constitute a second nozzle group, which is continuous as viewed from the second direction, for ejecting a second kind of liquid, wherein:

the casing body is formed with a chamber for accommodating a plurality of vibrator units which extends in a third direction which is orthogonal to the first direction and the second direction;

each of the vibrator units comprises:

a fixation board, fixed on an inner face of the chamber; and a plurality of piezoelectric vibrators, arranged on the fixation board in the first direction to cause pressure fluctuation in liquid contained in pressure generation chambers which are respectively communicated with the nozzles in one of the first nozzle array and the second nozzle array; and the second pair of faces extend in the third direction.

2. The liquid ejection head as set forth in claim 1, wherein the second pair of faces are parallel to each other as viewed from the third direction.

3. The liquid ejection head as set forth in claim 1, wherein a dimension of the fixation board in the first direction is greater than a length of each of the first nozzle array and the second nozzle array.

4. The liquid ejection head as set forth in claim 1, wherein lengths of the first nozzle array and the second nozzle array are identical with each other.

5. The liquid ejection head as set forth in claim 1, wherein the first kind of liquid and the second kind of liquid are identical with each other.

6. The liquid ejection head of claim 5, wherein:

the nozzles are arranged with a constant interval; and the first nozzle array and the second nozzle array are shifted relative to each other in the first direction by a half a constant interval.

7. The liquid ejection head as set forth in claim 1, wherein the first kind of liquid and the second kind of liquid are different from each other.

8. The liquid ejection head as set forth in claim 1, wherein:

each of the liquid ejection units comprises a first liquid reservoir communicated with the nozzles in the first nozzle array, and a second liquid reservoir communicated with the nozzles in the second nozzle array; and the first nozzle array and the second nozzle array are arranged between the first liquid reservoir and the second liquid reservoir, as viewed from a third direction which is orthogonal to the first direction and the second direction.

9. The liquid ejection head as set forth in claim 1, wherein:

the nozzles are arranged with a constant interval; and the first nozzle array and the second nozzle array are shifted relative to each other in the first direction by a half of the constant interval.

10. The liquid ejection head as set forth in claim 1, further comprising a holder, formed with a positioning member which determines positions of the liquid ejection units.

11. The liquid ejection head of claim 1, wherein:

the first nozzle array in one of the liquid ejection units and the first nozzle array in another of the liquid ejection units overlap in the first direction.

12. The liquid ejection head of claim 11, wherein the second nozzle array in one of the liquid ejection units and the second nozzle array in another of the liquid ejection units overlap in the first direction.

13. The liquid ejection head of claim 1, further comprising:

a positioning wall;

a plurality of positioning protrusions having first reference face and a second reference face, wherein:

the first reference face restrains the movement of a liquid ejection unit in the first direction and the second reference face restrains the movement of a liquid ejection unit in the second direction.

* * * * *